US009431160B2

(12) United States Patent
Inoue

(10) Patent No.: US 9,431,160 B2
(45) Date of Patent: Aug. 30, 2016

(54) SUPERCONDUCTING MAGNET

(75) Inventor: Tatsuya Inoue, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 219 days.

(21) Appl. No.: 14/355,367

(22) PCT Filed: Jan. 30, 2012

(86) PCT No.: PCT/JP2012/051931
§ 371 (c)(1),
(2), (4) Date: Apr. 30, 2014

(87) PCT Pub. No.: WO2013/114523
PCT Pub. Date: Aug. 8, 2013

(65) Prior Publication Data
US 2014/0274724 A1 Sep. 18, 2014

(51) Int. Cl.
*H01F 6/06* (2006.01)
*H01F 6/04* (2006.01)
*H01R 4/68* (2006.01)

(52) U.S. Cl.
CPC *H01F 6/04* (2013.01); *H01F 6/06* (2013.01); *H01F 6/065* (2013.01); *H01R 4/68* (2013.01)

(58) Field of Classification Search
CPC ..... H01F 6/04; H01F 6/06; H01F 6/065
See application file for complete search history.

(56) References Cited

U.S. PATENT DOCUMENTS 4,872,322 A 10/1989 Woods et al.
5,430,423 A 7/1995 Herd et al.
5,636,888 A 6/1997 Kiser et al.
6,889,068 B2 * 5/2005 Kai ..... H01P 1/30 333/260
2002/0187902 A1 12/2002 Kai et al.
2005/0193745 A1 9/2005 Mangano et al.

FOREIGN PATENT DOCUMENTS

CN 100528077 C 8/2009
JP 61-134063 U 8/1986
JP 61-134064 * 8/1986
JP 61-134064 U 8/1986

(Continued)

OTHER PUBLICATIONS

Translation of JP 61-134064, pp. 1-16.*

(Continued)

*Primary Examiner* — Colleen Dunn
(74) *Attorney, Agent, or Firm* — Buchanan Ingersoll & Rooney PC

(57) ABSTRACT

A superconducting magnet includes a superconducting coil, a helium tank that accommodates the superconducting coil and stores liquid helium therein, a radiation shield that surrounds a periphery of the helium tank, a vacuum vessel that accommodates the radiation shield, an exhaust port that is connected to the helium tank and exhausts gasified helium, a lead that electrically connects an external power supply and the superconducting coil and is attachable to and removable from the vacuum vessel, a connector that connects the lead and the superconducting coil, and a thermal conductive member having one end in contact with at least one of the connector and the exhaust port, and having the other end located outside the vacuum vessel and attachable to and removable from the vacuum vessel.

9 Claims, 4 Drawing Sheets

(56) References Cited

FOREIGN PATENT DOCUMENTS

| | | | | |
|---|---|---|---|---|
| JP | 62-4159 | U | | 1/1987 |
| JP | 62-4162 | U | | 1/1987 |
| JP | 63-89212 | U | | 6/1988 |
| JP | 2-150003 | A | | 6/1990 |
| JP | 9-139308 | A | | 5/1997 |
| WO | WO 01-57886 | | * | 8/2001 |
| WO | WO 01/57886 | A1 | | 8/2001 |

OTHER PUBLICATIONS

International Search Report (PCT/ISA/210) mailed on Mar. 27, 2012, by the Japanese Patent Office as the International Searching Authority for International Application No. PCT/JP2012/051931.

Office Action mailed on Nov. 27, 2012, by the Japanese Patent Office for Application No. 2012-544998 (7 pages).

Office Action dated Jan. 4, 2016 issued in the corresponding Chinese Patent Application No. 201280065968.1 and partial English translation (6 pages).

* cited by examiner

SUPERCONDUCTING MAGNET

TECHNICAL FIELD

The present invention relates to superconducting magnets.

BACKGROUND ART

Japanese Utility Model Laying-Open No. 63-89212 (PTD 1) is a prior art document which discloses an ice removing device that removes ice attached to connection terminals connected to a power supply lead. In the ice removing device for a superconducting magnet described in PTD 1, ice is melted by inserting the ice removing device through a connection pipe, and fitting an ice melting portion having a high heat capacity to the connection terminals.

CITATION LIST

Patent Document

PTD 1: Japanese Utility Model Laying-Open No. 63-89212

SUMMARY OF INVENTION

Technical Problem

When the lead is attached to and removed from a vacuum vessel, air or the like enters a helium tank within the vacuum vessel. The air that has entered the helium tank solidifies by being cooled with liquid helium within the helium tank. If the solidification occurs at a connection portion between the lead and the connection terminals, the lead cannot be pulled out of the vacuum vessel. Forced pulling of the lead causes breakage of the lead. In this case, the solidified product cannot be removed with the ice removing device.

Furthermore, if the solidification occurs at an exhaust port connected to the helium tank, gasified helium cannot be exhausted, and the superconducting coil cannot be cooled stably.

The present invention was made in view of the problem described above, and an object of the invention is to provide a superconducting magnet capable of removing a solidified product of air or the like.

Solution to Problem

A superconducting magnet according to the present invention includes a superconducting coil, a helium tank that accommodates the superconducting coil and stores liquid helium therein, a radiation shield that surrounds a periphery of the helium tank, a vacuum vessel that accommodates the radiation shield, and an exhaust port that is connected to the helium tank and exhausts gasified helium. The superconducting magnet also includes a lead that electrically connects an external power supply and the superconducting coil and is attachable to and removable from the vacuum vessel, and a connector that connects the lead and the superconducting coil. The superconducting magnet also includes a thermal conductive member having one end in contact with at least one of the connector and the exhaust port, and having the other end located outside the vacuum vessel and attachable to and removable from the vacuum vessel.

Advantageous Effects of Invention

According to the present invention, a solidified product of air or the like can be removed.

DESCRIPTION OF EMBODIMENTS

Figure 1:
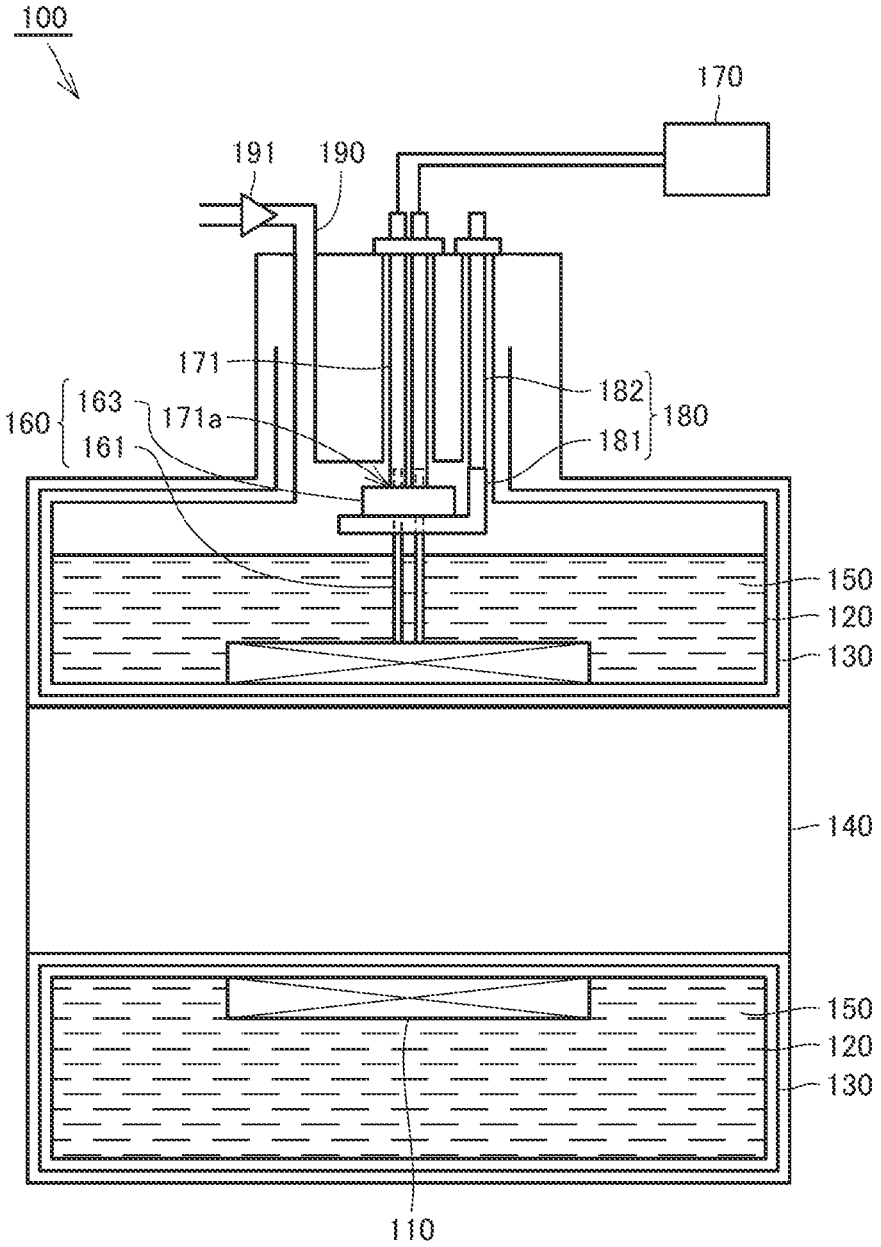
FIG. 1 is a cross-sectional view showing the structure of a superconducting magnet according to a first embodiment of the present invention.

A superconducting magnet according to a first embodiment of the present invention will be described hereinafter, referring to the drawings. In the description of the following embodiments, the same or corresponding parts in the figures are indicated by the same reference characters, and the description thereof will not be repeated.

First Embodiment

Figure 2:
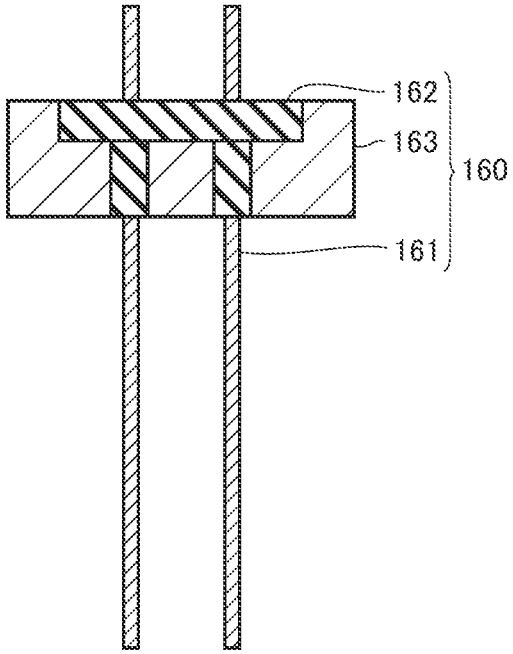
FIG. 2 is a cross-sectional view showing the structure of a connector of the superconducting magnet according to the first embodiment.

FIG. 1 is a cross-sectional view showing the structure of the superconducting magnet according to the first embodiment of the present invention. FIG. 2 is a cross-sectional view showing the structure of a connector of the superconducting magnet according to the first embodiment.

As shown in FIG. 1, superconducting magnet 100 according to the first embodiment of the present invention includes a superconducting coil 110 formed by winding a superconducting wire, a helium tank 120 that accommodates superconducting coil 110 and stores liquid helium 150 therein, a radiation shield 130 that surrounds a periphery of helium tank 120, and a vacuum vessel 140 that accommodates radiation shield 130. Radiation shield 130 is supported by a supporting member not shown here, so as to reduce heat transfer to helium tank 120.

Superconducting coil 110 is wound around a shaft of helium tank 120. Superconducting coil 110 is cooled with liquid helium 150 stored in helium tank 120.

An exhaust pipe 190, which is an exhaust port that exhausts gasified helium, is connected to helium tank 120. Exhaust pipe 190 is fitted with a valve 191 that is designed to open when the pressure in helium tank 120 has become equal to or higher than a prescribed pressure.

Superconducting magnet 100 is equipped with a refrigerator not shown here. A cooling portion in a first stage of the refrigerator is in contact with radiation shield 130. A cooling portion in a second stage, that is, an end portion, of the refrigerator is in contact with gasified helium in helium tank 120, to cool the gasified helium for re-liquefaction.

An external power supply 170 for passing current in superconducting coil 110 is connected to superconducting magnet 100. Superconducting magnet 100 is equipped with a lead 171 that electrically connects external power supply 170 and superconducting coil 110 and is attachable to and removable from vacuum vessel 140, and a connector 160 that connects lead 171 and superconducting coil 110.

As shown in FIG. 2, connector 160 includes connection terminals 161 that electrically connect lead 171 and superconducting coil 110, a main body 163 that holds connection terminals 161 and has thermal conductivity, and an electrical insulating portion 162 interposed between connection terminals 161 and main body 163.

Specifically, two connection terminals 161 penetrate rectangular parallelepiped-shaped main body 163 that is made of a metal such as copper. Electrical insulating portion 162 having electrical insulation properties, such as GFRP (Glass Fiber Reinforced Plastic), is disposed between connection terminals 161 and main body 163. Electrical insulating portion 162 ensures electrical insulation between connection terminals 161 and main body 163, and between connected lead 171 and main body 163. It is noted, however, that the shape of connector 160 and the material forming each element are not limited to those described above, and are set as desired.

As shown in FIG. 1, superconducting magnet 100 includes a thermal conductive member 180 having one end in contact with connector 160, and having the other end located outside vacuum vessel 140 and attachable to and removable from vacuum vessel 140.

In this embodiment, thermal conductive member 180 is made up of an L-shaped first thermal conductive member 181 fixedly disposed to be in contact with a lower surface of main body 163 of connector 160 in helium tank 120, and a bar-shaped second thermal conductive member 182 having a lower end surface in contact with an upper end surface of first thermal conductive member 181.

It is noted that first thermal conductive member 181 is fixed in a non-contact manner with connection terminals 161. Second thermal conductive member 182 is supported to be attachable to and removable from vacuum vessel 140. First thermal conductive member 181 and second thermal conductive member 182 are formed of copper. More specifically, first thermal conductive member 181 and second thermal conductive member 182 are formed of phosphorous-deoxidized copper.

The composition and material of thermal conductive member 180 are not limited to those described above, and thermal conductive member 180 may be integrally formed of a material having thermal conductivity. For example, the bar-shaped thermal conductive member may be disposed to have one end in contact with a side surface of main body 163 of connector 160, and the other end located outside vacuum vessel 140.

It is noted, however, that as in this embodiment, when first thermal conductive member 181 is brought into contact with a full length of main body 163 in a direction in which two connection terminals 161 are aligned, more uniform heating of main body 163 can be achieved.

Operation of superconducting magnet 100 according to this embodiment will be described hereinafter.

First, liquid helium 150 is cooled to about 4.2 K with the refrigerator, without lead 171 and second thermal conductive member 182 being mounted. At this time, air containing nitrogen, oxygen, or the like may solidify. If the solidification occurs near upper ends of connection terminals 161 connected to lead 171, lead 171 cannot be mounted in that condition.

Thus, second thermal conductive member 182 is mounted on vacuum vessel 140, and allows the lower end surface of second thermal conductive member 182 to contact the upper end surface of first thermal conductive member 181. Since an upper end portion of second thermal conductive member 182 is located outside vacuum vessel 140, the upper end portion of second thermal conductive member 182 absorbs heat from outside air outside vacuum vessel 140.

The heat absorbed at the upper end portion of second thermal conductive member 182 is transferred from the lower end surface of second thermal conductive member 182 to first thermal conductive member 181. The heat transferred to first thermal conductive member 181 is transferred to main body 163 of connector 160. With the heat transferred to main body 163, a solidified product formed near the upper ends of connection terminals 161 can be melted and removed. Since the solidification temperature of nitrogen, oxygen, or the like is considerably lower than the outside air temperature, the solidified product can be reliably removed by heating connector 160 via thermal conductive member 180, using the outside air as a heat source.

After removing the solidified product, lead 171 is mounted on vacuum vessel 140. Second thermal conductive member 182 is then removed. In this state, external power supply 170 is operated, thereby passing current in superconducting coil 110 through lead 171 and connector 160.

At the time of pulling out lead 171 because the magnetic field strength of superconducting magnet 100 has increased to a rated magnetic field and the current supply from external power supply 170 is no longer needed, the solidification may have occurred at a connection portion 171*a* between lead 171 and connection terminals 161 and thus, second thermal conductive member 182 is mounted on vacuum vessel 140 first.

As described above, main body 163 is heated with thermal conductive member 180 to melt and remove the solidified product formed at connection portion 171*a*. Lead 171 is then pulled out. In this way, lead 171 can be prevented from being subjected to a load. Finally, second thermal conductive member 182 is removed from vacuum vessel 140.

By attaching and removing lead 171 according to the method described above, it is possible to prevent lead 171 from becoming unable to be attached and removed due to the solidified product formed at connection terminals 161 and connection portion 171*a*.

A superconducting magnet according to a second embodiment of the present invention will be described hereinafter, referring to the drawings. It is noted that superconducting magnet 200 according to this embodiment differs from superconducting magnet 100 according to the first embodiment only in that a thermal conductive member 280 in contact with the exhaust port is additionally provided. The description of the rest of the structure will not therefore be repeated.

Second Embodiment

Figure 3:
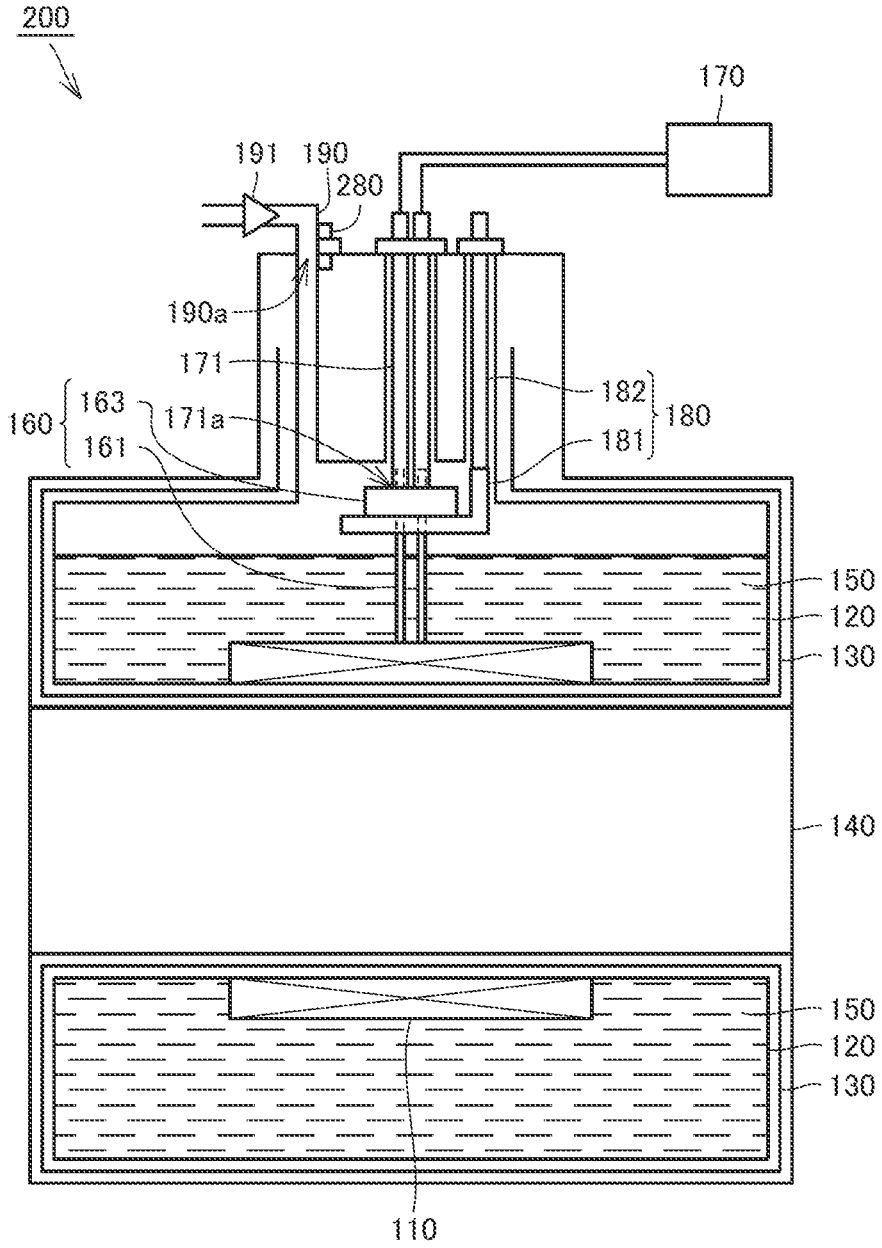
FIG. 3 is a cross-sectional view showing the structure of a superconducting magnet according to a second embodiment of the present invention.

FIG. 3 is a cross-sectional view showing the structure of the superconducting magnet according to the second embodiment of the present invention. As shown in FIG. 3, superconducting magnet 200 according to the second embodiment of the present invention includes a thermal conductive member 280 having one end in contact with exhaust pipe 190, and having the other end located outside vacuum vessel 140 and attachable to and removable from vacuum vessel 140.

In this embodiment, bar-shaped thermal conductive member 280 is disposed to have the one end in contact with a portion of an outer periphery of a port 190*a* of exhaust pipe 190, and the other end located outside vacuum vessel 140.

Thermal conductive member 280 is supported to be attachable to and removable from vacuum vessel 140. Thermal conductive member 280 is formed of copper. More specifically, thermal conductive member 280 is formed of phosphorous-deoxidized copper. It is noted, however, that the material of thermal conductive member 280 is not limited to this, and may be any material having thermal conductivity.

Operation of removing a solidified product formed at the exhaust port by superconducting magnet 200 according to this embodiment will be described hereinafter.

Helium tank 120 is equipped with a pressure sensor not shown here to measure the pressure in helium tank 120. If the solidification occurs at port 190*a* of exhaust pipe 190 connected to helium tank 120, gasified helium cannot be exhausted, causing the pressure in helium tank 120 to increase.

When the pressure in helium tank 120 has become equal to or higher than a prescribed pressure, it is determined that port 190*a* of exhaust pipe 190 is blocked with a solidified product, and thermal conductive member 280 is mounted on vacuum vessel 140. Since an upper end portion of thermal conductive member 280 is located outside vacuum vessel 140, the upper end portion of thermal conductive member 280 absorbs heat from outside air outside vacuum vessel 140.

The heat absorbed at the upper end portion of thermal conductive member 280 is transferred from a lower end portion of thermal conductive member 280 to exhaust pipe 190. With the heat transferred to exhaust pipe 190, the solidified product formed in the vicinity of port 190*a* of exhaust pipe 190 can be melted and removed.

After checking that the removal of the solidified product has allowed the gas to exhaust through exhaust pipe 190 and the pressure in helium tank 120 to decrease, thermal conductive member 280 is removed.

By removing the solidified product formed at the exhaust port according to the method described above, superconducting coil 110 can be cooled stably. Consequently, superconducting magnet 200 can be operated stably.

A superconducting magnet according to a third embodiment of the present invention will be described hereinafter, referring to the drawings. It is noted that superconducting magnet 300 according to this embodiment differs from superconducting magnet 100 according to the first embodiment only in that a thermal conductive member 380 in contact with both the connector and the exhaust port is additionally provided. The description of the rest of the structure will not therefore be repeated.

Third Embodiment

Figure 4:
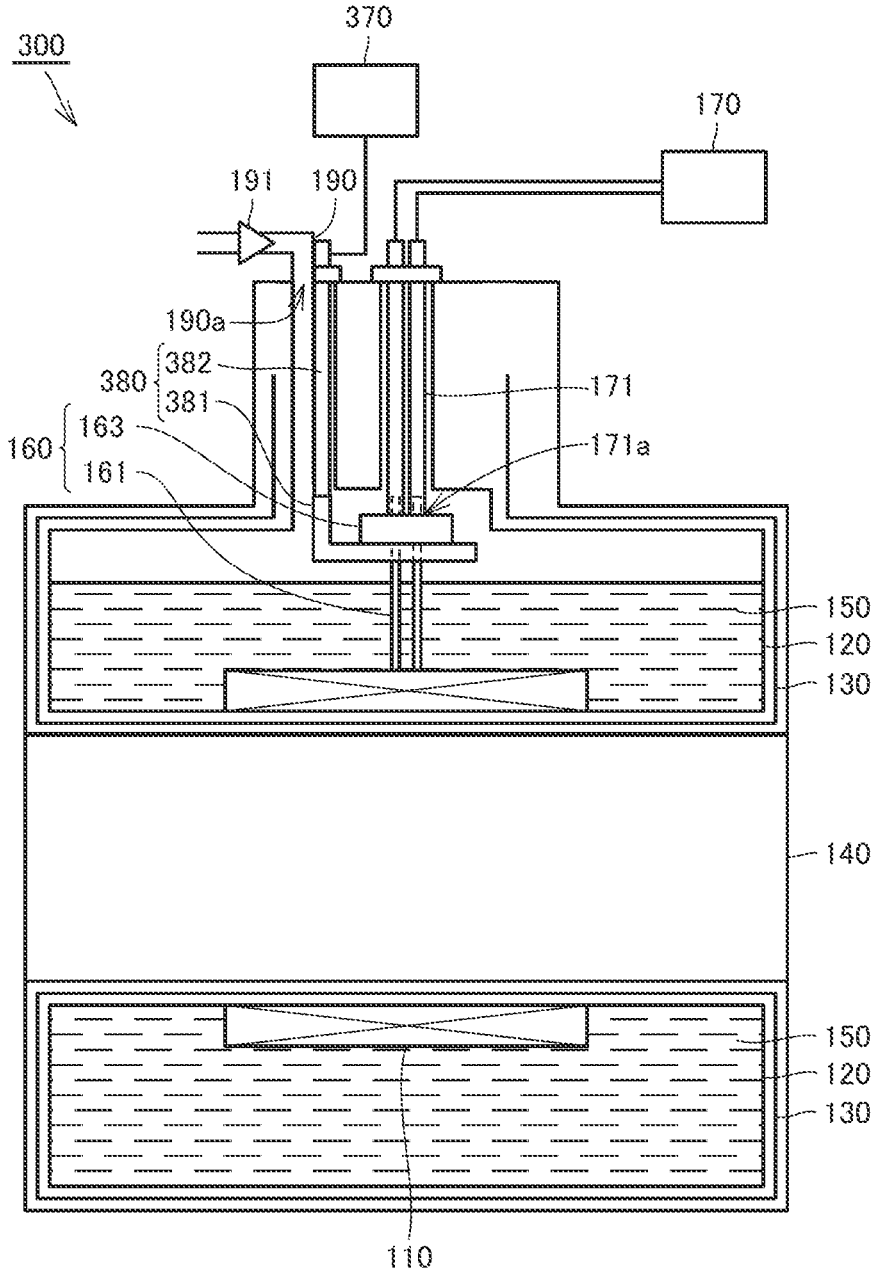
FIG. 4 is a cross-sectional view showing the structure of a superconducting magnet according to a third embodiment of the present invention.

FIG. 4 is a cross-sectional view showing the structure of the superconducting magnet according to the third embodiment of the present invention. As shown in FIG. 4 superconducting magnet 300 according to the third embodiment of the present invention includes thermal conductive member 380 having one end in contact with main body 163 of connector 160 and exhaust pipe 190 in vacuum vessel 140, and having the other end located outside vacuum vessel 140 and attachable to and removable from vacuum vessel 140.

In this embodiment, thermal conductive member 380 is made up of an L-shaped first thermal conductive member 381 fixedly disposed to be in contact with a lower surface of main body 163 of connector 160 in helium tank 120, and a bar-shaped second thermal conductive member 382 having a lower end surface in contact with an upper end surface of first thermal conductive member 381.

It is noted that first thermal conductive member 381 is fixed in a non-contact manner with connection terminals 161. Second thermal conductive member 382 is supported to be attachable to and removable from vacuum vessel 140. First thermal conductive member 381 and second thermal conductive member 382 are formed of copper. More specifically, first thermal conductive member 381 and second thermal conductive member 382 are formed of phosphorous-deoxidized copper.

The composition and material of thermal conductive member 380 are not limited to those described above, and thermal conductive member 180 may be integrally formed of a material having thermal conductivity. For example, the bar-shaped thermal conductive member may be disposed to have one end in contact with a side surface of main body 163 of connector 160 and a portion of the outer periphery of port 190*a* of exhaust pipe 190, and having the other end located outside vacuum vessel 140.

With this structure, main body 163 can be heated with thermal conductive member 380 to melt and remove a solidified product formed at connection portion 171*a*, and also melt and remove a solidified product formed in the vicinity of port 190*a* of exhaust pipe 190.

Consequently, it is possible to prevent lead 171 from becoming unable to be attached and removed due to the solidified product formed at connection terminals 161 and connection portion 171*a*, and also cool superconducting coil 110 stably.

Furthermore, superconducting magnet 300 according to this embodiment further includes a heating unit 370 that heats the other end of second thermal conductive member 382. Any of various heaters such as a resistance heater or a warm air heater can be used as heating unit 370. By heating second thermal conductive member 382 with heating unit 370, the time needed to melt the solidified product can be shortened. It is noted, however, that superconducting magnet 300 may not necessarily include heating unit 370.

It should be noted that the foregoing embodiments disclosed herein are illustrative in every respect, and do not form a basis of any limitative interpretation. Accordingly, the technical scope of the present invention shall not be interpreted using the foregoing embodiments only, but shall be defined based on the claims.

Furthermore, the present invention includes any modifications within the scope and meaning equivalent to the terms of the claims.

REFERENCE SIGNS LIST

100, 200, 300: superconducting magnet; 110: superconducting coil; 120: helium tank; 130: radiation shield; 140: vacuum vessel; 150: liquid helium; 160: connector; 161: connection terminal; 162: electrical insulating portion; 163: main body; 170: external power supply; 171: lead; 171*a*: connection portion; 180, 280, 380: thermal conductive member; 181, 381: first thermal conductive member; 182, 382: second thermal conductive member; 190: exhaust pipe; 190*a*: port; 191: valve; 370: heating portion.

The invention claimed is:

1. A superconducting magnet comprising:

a superconducting coil;

a helium tank that accommodates said superconducting coil and stores liquid helium therein;

a radiation shield that surrounds a periphery of said helium tank;

a vacuum vessel that accommodates said radiation shield;

an exhaust port that is connected to said helium tank and exhausts gasified helium;

a lead that electrically connects an external power supply and said superconducting coil and is attachable to and removable from said vacuum vessel;

a connector that connects said lead and said superconducting coil; and a thermal conductive member having one end in contact with said connector and said exhaust port, and having the other end located outside said vacuum vessel and attachable to and removable from said vacuum vessel, said connector including two connection terminals that electrically connect said lead and said superconducting coil, a main body that holds said two connection terminals and has thermal conductivity, and an electrical insulating portion interposed between said two connection terminals and said main body, and said thermal conductive member being in contact with a full length of said main body in a direction in which said two connection terminals are aligned.

2. A superconducting magnet comprising:

a superconducting coil;

a helium tank that accommodates said superconducting coil and stores liquid helium therein;

a radiation shield that surrounds a periphery of said helium tank;

a vacuum vessel that accommodates said radiation shield;

an exhaust port that is connected to said helium tank and exhausts gasified helium;

a lead that electrically connects an external power supply and said superconducting coil and is attachable to and removable from said vacuum vessel;

a connector that connects said lead and said superconducting coil; and a thermal conductive member having one end in contact with said connector and said exhaust port, and having the other end located outside said vacuum vessel and attachable to and removable from said vacuum vessel.

3. The superconducting magnet according to claim 2, further comprising a heating unit that heats the other end of said thermal conductive member.

4. The superconducting magnet according to claim 2, wherein said connector includes a connection terminal that electrically connects said lead and said superconducting coil, a main body that holds said connection terminal and has thermal conductivity, and an electrical insulating portion interposed between said connection terminal and said main body.

5. The superconducting magnet according to claim 1, wherein said thermal conductive member contains copper.

6. The superconducting magnet according to claim 1, wherein the thermal conductive member is L-shaped.

7. The superconducting magnet according to claim 2, wherein the thermal conductive member is L-shaped.

8. The superconducting magnet according to claim 1, wherein a portion of the thermal conductive member is disposed below the main body of the connector, and another portion of the thermal conductive member is disposed above the connector.

9. The superconducting magnet according to claim 2, wherein a portion of the thermal conductive member is disposed below the main body of the connector, and another portion of the thermal conductive member is disposed above the connector.

* * * * *